US006024308A

United States Patent [19]

Bartels et al.

[11] Patent Number: 6,024,308

[45] Date of Patent: Feb. 15, 2000

[54] CONICALLY TAPERED DISC-SHAPED COMMINUTION ELEMENT FOR A DISC REFINER

[75] Inventors: Patrick J. Bartels, Sussex; Gregory A. Garasimowicz, Mukwonago, both of Wis.; Mattias E. Löfgren, Yzlan, Sweden; Petri K. Savujärvi, Brookfield, Wis.

[73] Assignee: J&L Fiber Services, Inc., Waukesha, Wis.

[21] Appl. No.: 09/189,578

[22] Filed: Nov. 11, 1998

[51] Int. Cl.[7] ..... B02C 7/12

[52] U.S. Cl. ..... 241/27; 241/28; 241/261.3; 241/297

[58] Field of Search ..... 241/261.2, 261.3, 241/297, 27, 28, 296

[56] References Cited

U.S. PATENT DOCUMENTS

| | | | |
|---|---|---|---|
| H1704 | 1/1998 | Wallajapet et al. . | |
| 2,008,892 | 9/1935 | Asplund . | |
| 2,156,321 | 5/1939 | Sutherland, Jr. . | |
| 2,937,815 | 5/1960 | Eirich et al. . | |
| 3,240,437 | 3/1966 | Horstman . | |
| 3,684,200 | 8/1972 | Reinhall . | |
| 4,039,154 | 8/1977 | Peterson | 241/261.3 |
| 4,220,290 | 9/1980 | Johannson . | |
| 4,221,631 | 9/1980 | Hellerqvist et al. . | |
| 4,283,016 | 8/1981 | Reinhall | 241/21 |
| 4,423,845 | 1/1984 | Frazier et al. . | |
| 5,040,736 | 8/1991 | Obitz | 241/247 |
| 5,165,592 | 11/1992 | Wasikowski . | |
| 5,203,514 | 4/1993 | Mokvist et al. | 241/81 |
| 5,335,865 | 8/1994 | Kohler et al. . | |
| 5,425,508 | 6/1995 | Chaney . | |
| 5,449,122 | 9/1995 | Berger et al. . | |
| 5,467,931 | 11/1995 | Dodd . | |
| 5,476,228 | 12/1995 | Underberg . | |
| 5,492,548 | 2/1996 | Wasikowski . | |
| 5,690,286 | 11/1997 | Dodd et al. . | |
| 5,704,559 | 1/1998 | Froberg et al. | 241/261.3 |
| 5,707,019 | 1/1998 | Aikawa . | |
| 5,747,707 | 5/1998 | Johansson et al. | 241/261.3 X |
| 5,823,453 | 10/1998 | Garasimowicz | 241/261.3 |
| 5,824,265 | 10/1998 | Dodd . | |
| 5,875,982 | 3/1999 | Underberg . | |

FOREIGN PATENT DOCUMENTS

WO 95/25199 9/1995 WIPO .

*Primary Examiner*—John M. Husar
*Attorney, Agent, or Firm*—Nilles & Nilles, S.C.

[57] ABSTRACT

A refiner for refining material has a refiner disc arrangement whereby the outermost opposed refiner disc annuli have a particular corresponding refiner surface arrangement. A carrier element has a mounting surface, a central axis, and defines a plane generally perpendicular to its axis of rotation. An annular first disc is carried on the mounting surface concentrically relative to the central axis and has a first refiner surface facing outward relative to the mounting surface. A plurality of refiner bars protrudes axially from and extends generally radially along the refiner surface. A second carrier element is spaced from and confronts the first carrier element and has a second mounting surface thereon. An annular second disc is carried on the second mounting surface concentrically relative to the central axis and has a second refiner surface confronting the first refiner surface. A plurality of second refiner bars protrudes axially from and extends generally radially along the second refiner surface. A refining plane is defined between the first and second refining surfaces that is angled relative to the generally perpendicular plane and provides a generally consistent width refining gap over a substantial portion of the refining surfaces.

29 Claims, 4 Drawing Sheets

CONICALLY TAPERED DISC-SHAPED COMMINUTION ELEMENT FOR A DISC REFINER

FIELD OF THE INVENTION

The present invention relates generally to a comminution apparatus for refining materials, and in particular to a disc-shaped comminution element used in a disc refiner for processing and refining materials into smaller components.

BACKGROUND OF THE INVENTION

Comminution apparatuses are used to refine material, such as fibrous material, grains, non-fibrous materials, and other materials, typically by grinding them into smaller fibers, pieces, or components. Disc refiners are a type of comminution apparatus known in the art for processing many materials from a course grade to a finer grade and even into individual fibers. For example, in the papermaking industry wood chips or other raw fiber stock materials are ground into smaller chips or mechanically treated so that the chips may be broken down further and refined into individual fibers. After refining these stock materials, the individual fibers are typically used to make paper related products, such as sheet paper, toilet paper, paper towels, and other absorbent products. In other industries, the treated individual fibers are utilized to produce certain other products as well. Other such industries are known and include, for example, plastic, thermoplastic and recycled plastic products. Disc refiners in general are utilized to brake down clumps of fibers into individual fibers. Such a disc refiner typically includes a pair of opposed and disc-shaped comminution elements referred to as refiner discs. Each disc typically includes one or more disc-shaped steel or steel-alloy castings having an array of generally radially extending ridges or refiner bars protruding from a refining face or surface of the disc. Refining discs may be formed of one or more continuous annular discs or annuli, or may instead be formed from a plurality of disc segments arranged on the disc relative to one another to form one or more rings or annuli.

One of the pair of opposed refiner discs is mounted on a rotor for rotation therewith and the other disc is mounted on a separate mounting surface which is either fixed or rotatable. The discs are typically opposed so that their refining surfaces face one another defining a gap between them. The refining surfaces are generally placed very close to one another, typically spaced apart from each other no farther than about 0.040 inches. The second refining disc may be attached to a fixed surface of the refiner or to a separate rotor for rotation therewith so that the pair of refiner discs rotate simultaneously relative to one another. As the material to be refined enters the gap between the discs, the relative motion between the refining surfaces breaks down the stock material to a desired degree.

It is desirable that the stock material to be refined remain between the refining surfaces of the two discs long enough to achieve a desired degree of refinement or fiber development. In order to facilitate easy repair and replacement of the refining surfaces, a plurality of annular discs are preferred in the art. Each disc can therefore include a plurality of annular discs or annuli arranged radially spaced apart from one another on the disc. Each disc annulus typically confronts on a facing disc an identical disc annulus whereby the two confront and rotate with respect to one another during operation of the refiner. The disc annuli typically axially taper toward a refining plane between the opposed discs in a direction moving from the radial inner edge to the radial outer edge of each disc annulus. Each opposing disc annulus also typically tapers in the same fashion or at the same angle toward the refining plane as its confronting annulus.

High consistency refiner discs that are generally flat suffer from operational problems that relate to high rotational speeds, large disc diameters, and high power or load input characteristics. The high rotational speed, typically about 1200 rpm or higher, significantly reduces the time the fiber material resides within the gap between the opposed discs and disc annuli. The time the material stays between the discs is referred to as residency time. The reduced residency time and high rotational speed produce a high intensity refining or development and fiber cutting of the stock material. However, the reduced residency time limits further fiber development, desired for producing strong fibers, that typically only occurs when residency time is increased.

The large disc diameters typically associated with these types of discs also reduce the residency time of the stock material between the discs. This is caused by the relationship between disc diameter and the angular acceleration of the stock material between the discs. More specifically, a disc having a larger diameter will impart a greater angular acceleration to the material as the material moves farther radially outwardly relative to the disc than a disc having a smaller diameter. This increased angular acceleration typically causes steam evacuation problems and undesirably high steam pressures within the refining zone or gap between the discs. Steam evacuation problems can cause steam build up which, in turn, can lead to vibration and upsetting of the refiner discs. Vibration and upsetting of either disc causes the refining gap between the discs to frequently vary during operation. This can cause the discs to clash or contact one another and can produce pulp of poor quality after refinement.

Because of the resistance to steam evacuation from the refining gap between the discs, an undesirably high steam pressure can develop between the discs that directly opposes the thrust urging the discs toward each other. Therefore, a greater thrust is needed than is expected without steam in order to produce an equivalent horsepower with high consistency refiners. This phenomenon becomes a problem when the mechanical limitations of the refiner do not allow for the proper or additional thrust force necessary to apply an adequate amount of refining power to the fibers of the stock material.

In a flat disc refiner, residency time is to some degree controlled by upraised dams that are disposed between elongate upraised bars of a refiner disc that define grooves through which the stock material flows. The dams help control residency time by obstructing the flow of stock material through the grooves, requiring the stock material within the refining zone to find alternative paths to the outer diameter of the discs. The use of such dams to control the residency time, however, also undesirably further increases the steam pressure within the refining zone because of the obstruction to the flow of steam as well as stock material between the discs.

What is needed is a disc-shaped comminution element for a comminution apparatus that preferably is a disc for a disc refiner that increases residency time for an element of a given diameter and when operated at high rotational speeds. What is further needed is a refiner disc that has a configuration that minimizes steam build up between opposed discs for minimizing vibration and upsetting of the discs. What is still further desired is a refiner disc that increases residency time while minimizing the use of dams.

SUMMARY OF THE INVENTION

The present invention is directed to a conical disc annulus which has a novel refining arrangement and orientation defined between the flat discs. The conical disc annuli described herein provide several advantages and solve several problems known in the prior art discussed above. One advantage of the present invention is that the conical disc annuli counteract the effects of the high rotational speeds required for high consistency refiners. Another advantage of the present invention is that the conical disc annuli also counteract the consequences of using larger disc diameters necessary for adequately refining the stock material. An additional advantage of the present invention is that the conical disc annuli increase the residency time of the stock material within the refining gap between the discs. A further advantage of the present invention is that the conical disc annuli introduce a restriction to the centrifugal force that tends to urge the material being refined outwardly in a radial direction toward the outer diameter of each disc thereby increasing residency time. Another advantage of the present invention is that the conical disc annuli increase the residency time of the stock material between the discs that thereby improves fiber development within the refiner. A further advantage of the present invention is that the conical disc annuli do not adversely restrict steam evacuation from the refining zone. An additional advantage of the present invention is that the conical disc annuli reduce the number of dams necessary to achieve an equivalent residency time when compared to a conventional flat disc refiner. A still further advantage of the present invention is that the conical disc annuli, by their geometry, also help to prevent refiner disc vibration and upset otherwise caused by any steam pressure fluctuations.

In one embodiment, a refiner disc assembly has a carrier element with a mounting surface and a central axis. The refiner disc assembly defines a refining plane generally perpendicular to the central axis. An annular first disc is carried on the mounting surface concentrically relative to the central axis and has a first refiner surface facing outward relative to the mounting surface. A plurality of refiner bars protrude axially from and extend generally radially along the refiner surface. The first refiner surface defines a secondary refining plane disposed at a taper angle relative to the primary refining plane.

In one embodiment, the first carrier element is a rotor which rotates about the central axis of a stock material disc refiner. In another embodiment, the first carrier element is a stator which is affixed to a portion of a housing of a stock material disc refiner.

In one embodiment, the refiner disc assembly also has an inner annular second disc carried on the mounting surface which is arranged radially inward and concentrically spaced from the first disc. The second disc is disposed entirely between the primary refining plane and the mounting surface.

In another embodiment, an inner annular third disc is also carried on the mounting surface entirely between the primary refining plane and the mounting surface and is arranged radially inward and concentrically spaced from the second disc.

In one embodiment, the refiner disc assembly has a plurality of concentrically spaced apart annular refiner discs carried on the mounting surface. Each of the plurality of discs is disposed entirely between the primary refining plane and the mounting surface wherein at least one of the discs is arranged radially inward relative to the first disc.

In one embodiment, the taper angle of the secondary refining plane is greater than 0 degrees and about 20 degrees. In another embodiment, the taper angle is about 3 degrees. In a still further embodiment, the taper angle is about 5 degrees. Preferably, the taper angle is no greater than about 20 degrees.

In one embodiment, the first refiner surface extends at least partially over the primary refining plane so that a portion of the first refiner surface lies on each side of the primary refining plane.

In one embodiment, a refiner disc assembly has a rotary first carrier element which has a first mounting surface and a central axis. An annular first disc is carried on the first mounting surface concentrically relative to the central axis and has a first refining surface which faces outward from the mounting surface. A plurality of first refiner bars protrude axially from and extend generally radially along the first refiner surface. A second carrier element is spaced from and confronts the first carrier element and has a second mounting surface. An annular second disc is carried on the second mounting surface concentrically relative to the central axis and has a second refiner surface which confronts the first refiner surface. A substantial portion of the first and second refiner surfaces are disposed generally parallel to one another. A plurality of second refiner bars protrude axially from and extend generally radially along the second refiner surface. A primary refining plane is defined between the first and second carrier elements and is generally perpendicular to the central axis. A secondary refining plane is defined between the first and second refiner surfaces and is oriented at a taper plane angle relative to the primary refining plane.

In one embodiment, a portion of at least one of the first and second refiner surfaces is disposed partially on each side of the primary refining plane.

In one embodiment, the refiner disc assembly also has at least an annular third disc carried on the first mounting surface concentrically relative to the central axis and located radially inward of the first disc. The third disc has an inner perimeter edge, an outer perimeter edge, a third refiner surface, and a plurality of third refiner bars which protrude axially from and extend generally radially along the third refiner surface. The refiner disc assembly also has at least an annular fourth disc carried on the second mounting surface concentrically relative to the central axis and confronting the third disc. The fourth disc has an inner perimeter edge, an outer perimeter edge, a fourth refiner surface, and a plurality of fourth refiner bars protruding axially from and extending generally radially along the fourth refiner surface. The third and fourth refiner surfaces are each tapered at a taper angle relative to the primary refining plane toward one another in a direction from their respective inner perimeter edges to their respective outer perimeter edges. Thus, the third and fourth refiner surfaces define a narrowing refiner gap therebetween in a radially outward direction.

In one embodiment, the taper angle of each of the third and fourth refiner surfaces is about 5 degrees relative to the primary refining plane.

In one embodiment, the taper angle of each of the third and fourth refiner surfaces is about 3 degrees relative to the primary refining plane.

In one embodiment, the taper plane angle of the secondary refining plane is between about 0 degrees and about 20 degrees relative to the primary refining plane.

In one embodiment, the refiner disc assembly also includes an inner perimeter edge and an outer perimeter edge on each of the first and second discs. The first refiner surface tapers toward one of the first and second carrier elements from its inner perimeter edge to its outer perimeter edge. The second refiner surface tapers toward the same one of the first and second carrier elements from its inner perimeter edge to its outer perimeter edge.

In one embodiment, at least one of the first and second refiner surface extends partially over the primary refining plane.

In one embodiment, one of the first and second refiner surfaces extends partially over the primary refining plane. The other of the first and second refiner surfaces is disposed entirely on one side of the primary refining plane. An inlet portion of the other of the refiner surfaces is disposed adjacent an inner perimeter edge of the respective disc and is generally parallel to the primary refining plane.

In one embodiment, the second carrier element is a rotary carrier element whereby the first and second carrier elements each rotate relative to one another in opposite rotational directions.

In one embodiment, the refiner disc assembly is adapted for refining a wood stock material including woodchips for the process of making paper products and wood-fiber based products.

In one embodiment, a stock material refiner includes a housing having a refining chamber therein. A stock material inlet of the housing communicates with the refining chamber for receiving a stock material to be refined. An auger is carried on a rotary shaft within the refining chamber and rotates about an axis. A first carrier element is concentrically and rotationally mounted relative to the axis within the refining chamber. The first carrier element has a first mounting surface on which an annular first disc is mounted concentrically relative to the axis and has a first refining surface which faces outward from the first mounting surface. A plurality of first refiner bars protrude axially from and extend generally radially along the first refiner surface. A second carrier element is spaced from and confronts the first carrier element within the refining chamber and has a second mounting surface thereon. An annular second disc is carried on the second mounting surface concentric relative to the axis and has a second refiner surface confronting the first refiner surface. A substantial portion of the first and second refiner surfaces are disposed generally parallel to one another. A plurality of second refiner bars protrude axially from the second refiner surface and extend generally radially along the second refiner surface. A primary refining plane is defined between the first and second carrier elements and generally perpendicular to the axis. A secondary refining plane is defined between the generally parallel substantial portions of the first and second refiner surfaces and is orientated at a taper plane angle relative to the primary refining plane.

In one embodiment, the first carrier element of the refiner is mounted to and rotates in conjunction with the rotary shaft.

In one embodiment, the second carrier element of the refiner is stationary and is mounted to a portion of the housing.

In one embodiment, the second carrier element is rotationally mounted within the refining chamber and rotates concentrically and in an opposite direction relative to the first carrier element.

In one embodiment, the stock material refiner is adapted for use in refining wood pulp stock material including woodchips for the process of making paper products.

In one embodiment, a method of refining a stock material includes providing a material refiner having a housing and a pair of opposed carrier elements within the housing which rotate relative to one another about an axis. Each carrier element has a mounting surface and at least one annular first refiner disc on each mounting surface. Each first refiner disc has a first refiner surface with a plurality of refiner bars thereon which face away from the mounting surface of each carrier element. The first refiner surfaces are orientated so that a substantial portion of each is parallel to the other to define a secondary refining plane between the surfaces. The secondary refining plane is orientated at an angle relative to a primary refining plane defined between the carrier elements and disposed generally perpendicular to the axis. Stock material is moved between the carrier elements into a refining gap between the first refiner surfaces. At least one of the first refiner discs is rotated relative to the other so as to refine the stock material between the first refiner surfaces. Stock material is thus propelled radially outward relative to the axis.

In one embodiment, a method of refining a stock material includes providing a refiner having a housing and a pair of opposed carrier elements within the housing which rotate relative to one another about an axis. A primary refining plane is defined between the opposed carrier elements generally perpendicular to the axis. Each carrier element has a mounting surface and at least one annular first refiner disc carried thereon wherein each first refiner disc has a first refiner surface with a plurality of refiner bars extending therefrom. The first refiner discs are oriented so that the first refiner surfaces are closely spaced relative to one another forming a refiner gap therebetween. A substantial portion of the first refiner surfaces are parallel to one another based upon their orientation so that substantial portions of each define a secondary refining plane therebetween and at an angle relative to the primary refining surface. Stock material is then delivered into the housing of the refiner. At least one of the carrier elements is rotated relative to the other. Stock material is then urged into the refining gap and is thus refined between the first refiner surfaces of the opposed annular discs.

These and other objects, features and advantages of the present invention will become apparent to those skilled in the art from the following detailed description and accompanying drawings. It should be understood however that the detailed description and specific examples, while indicating preferred embodiments of the present invention, are given by way of illustration and not of limitation. Many modifications and changes within the scope of the present invention may be made without departing from the spirit thereof, and the invention is intended to include all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE INVENTION

I. Introduction

Figure 1:
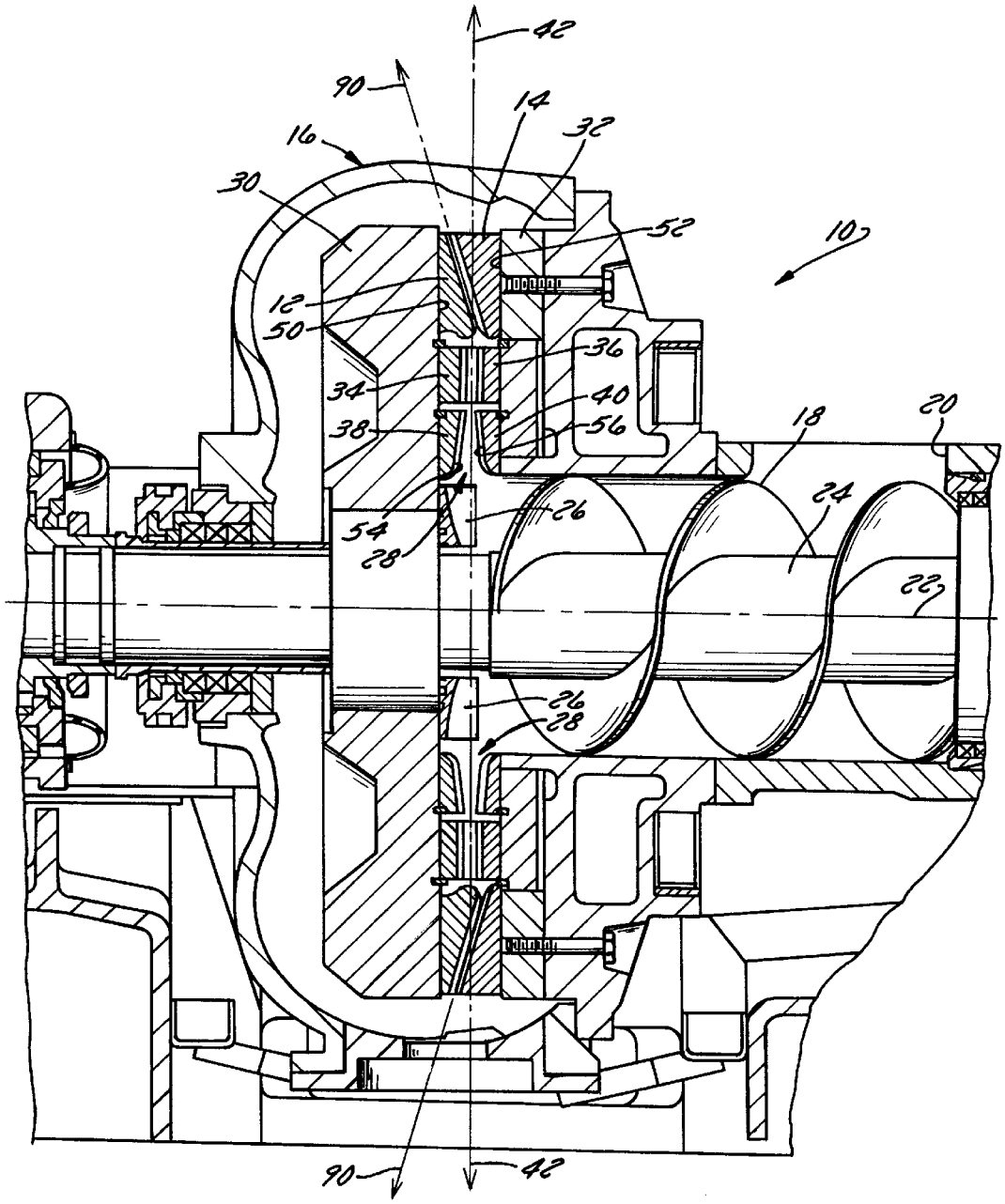
FIG. 1 illustrates a fragmentary cross-sectional view of an exemplary disc refiner having a refiner disc construction which includes the conical disc annuli constructed in accordance with one embodiment of the present invention.

Referring now to FIG. 1, a pulp refiner 10 is illustrated which includes a pair of annular or ring-shaped conical comminution elements 12 and 14 constructed in accordance with one embodiment of the invention and which are referred to further herein as refiner disc annuli. The refiner disc annuli 12 and 14 each taper in a direction and to a degree to essentially define a pair of closely spaced conical annular discs which oppose one another. The construction and function of the refiner disc annuli 12 and 14 are described in greater detail below. The geometry as best viewed in FIG. 1 and defined by the confronting relationship between each disc annulus 12 and 14 provides the noted advantages over the conventional flat disc refiner construction.

II. Refiner

As illustrated in FIG. 1, the refiner 10 has a housing 16 and an auger 18 mounted therein which helps supply pulp or stock material introduced to the refiner 10 through a stock inlet. The auger 18 is rotationally mounted within the housing 16 and rotates about a central axis 22 and is carried on a rotating shaft 24 concentric with the central axis 22. Also carried on the rotating shaft 24 is a flinger nut 26 which propels stock material urged toward the finger nut by the auger 18. The stock material is propelled into a refining area or gap 28 between the refining elements defined herein.

Also carried on the rotating shaft 24 is a first carrier element or rotor 30. This rotor 30 defines a portion of the refiner disc assembly as is described in more detail below. In the present embodiment, another portion of the refiner disc assembly is carried on a portion of the housing as a stator or stationary second carrier element 32, also described in more detail below. A plurality of refiner disc annuli are carried on each of the carrier elements 30 and 32. These disc annuli include the refiner disc annuli 12 and 14 which embody the subject matter of the present invention as well as additional opposed pairs of refiner disc annuli 34, 36, 38, and 40. A primary refining plane 42 which is oriented generally perpendicular to the central axis 22 is defined between the first and second carrier elements 30 and 32 within the refining gap 28. The refining plane generally defines the direction of material flow radially outward relative to the central axis during operation of the disc refiner 10.

Figure 2:
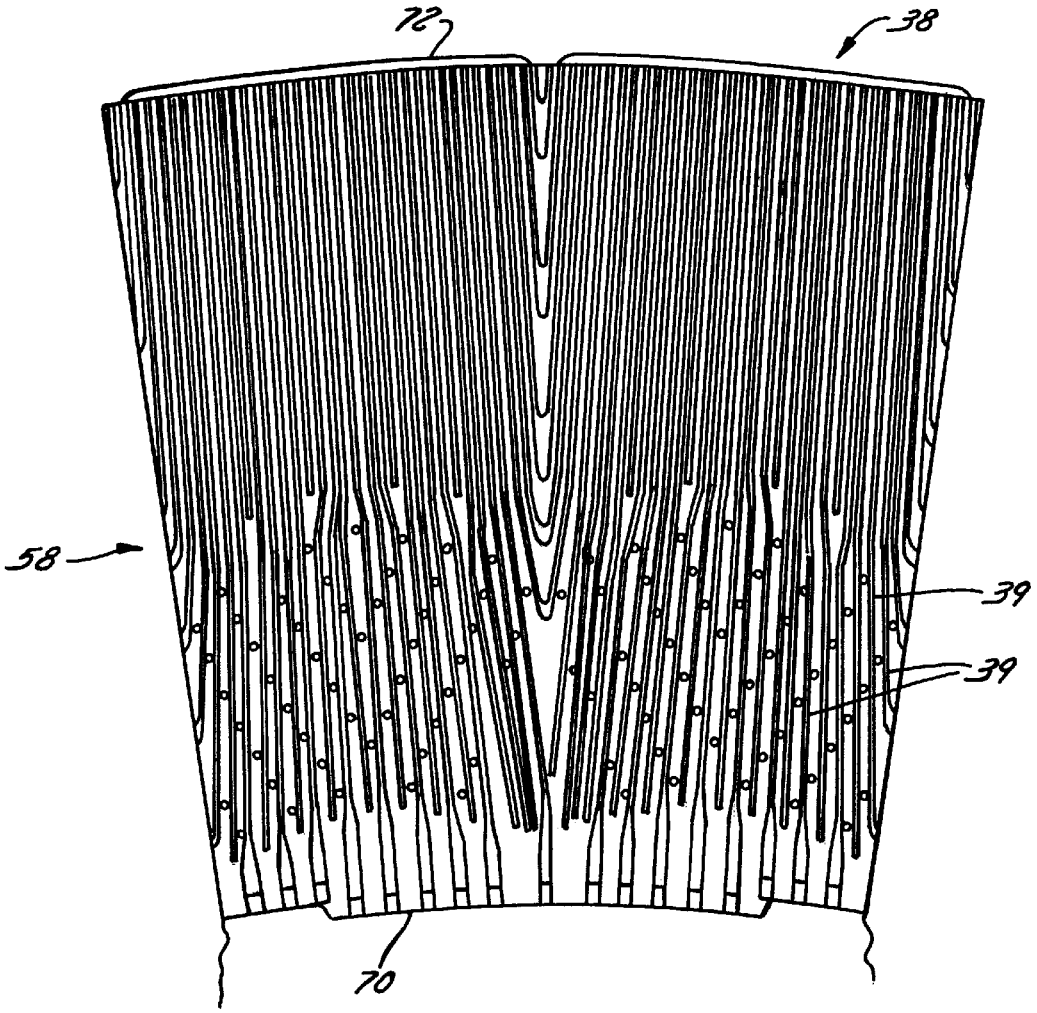
FIG. 2 illustrates a front view of the refining surface of a segment of one of the refiner disc annuli shown in FIG. 1.
Figure 3:
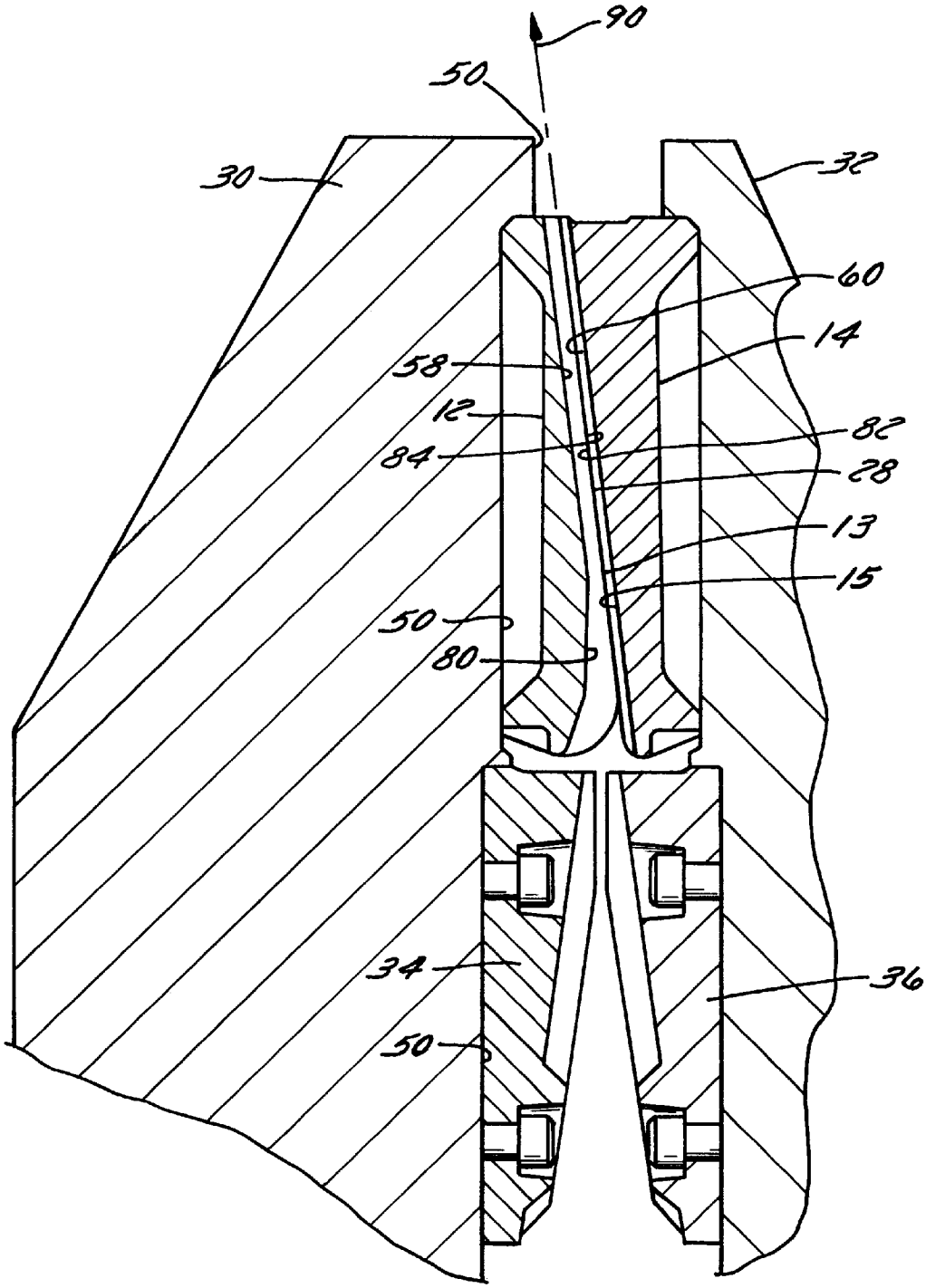
FIG. 3 is a cross-sectional view of a pair of exemplary refiner discs including the conical disc annuli of the present invention.

As best illustrated in FIGS. 1 and 2, each of the refiner disc annuli 12, 14, 34, 36, 38 and 40 includes a plurality of upraised ridges, breaker bars or refiner bars thereon. The refiner bars for each of the above mentioned refiner discs will be identified by refiner bar reference numbers 13, 15, 35, 37, 39, and 41 which respectively refer to the refiner bars of the corresponding and precedingly numbered refiner disc annuli 12, 14, 34, 36, 38 and 40 in order to simplify the discussion herein. FIG. 3 illustrates a cross-section and partial fragmentary view of a portion of the disc annulus arrangement of the refiner 10 and is discussed in greater detail below with regard to the novel features of the present invention.

Each refiner disc annulus and corresponding refiner bars generally grind, shear and develop stock material urged within the refining gap 28 and radially outward relative to the central axis 22. The material is refined by the relative rotational movement between the first and second carrier elements 30 and 32 and the action created by the refiner bars which oppose one another across the gap as is known in the art. As will be evident to those skilled in the art, the number of refiner disc annuli associated with each carrier element may vary without departing from the scope of the present invention. The number and design of the refiner disc annuli may be appropriately selected by the practitioner depending upon the refining characteristics necessary for a particular stock material application.

As will also be evident to those skilled in the art, the construction of the respective first and second carrier elements 30 and 32 may also vary considerably without departing from the scope of the present invention. For example, each of the first and second carrier elements 30 and 32 may rotate relative to one another instead of the second carrier element being fixed to the housing 16. Additionally, the attachment of each refiner disc annulus to their respective carrier elements may also vary considerably without departing from the scope of the present invention.

III. Refiner Disc Construction

As best illustrated in FIGS. 1 and 3, the construction of each refiner disc apparatus or assembly which includes each of the carrier elements 30 and 32 as well as the respective refiner disc annuli 12, 14, 34, 36, 38 and 40 provides the essence of the present invention. The first carrier element or rotor 30 includes a first mounting surface 50 facing the refining gap 28 and disposed generally parallel to the refining plane 42. Carried on the mounting surface 50 are the refiner disc annuli 12, 34 and 38. Each of the refiner disc annuli 12, 34 and 38 are in the form of an annular ring or annulus concentrically arranged relative to the central axis 22 on the rotor or carrier element 30. The refiner disc annulus 12 is the outermost disc, the refiner disc annulus 38 is the innermost disc and the refiner disc annulus 34 is arranged radially between the disc 12 and disc 38. Similarly, the second carrier element 32 includes a mounting surface 52 on which the corresponding disc annuli 14, 36 and 40 are carried. The refiner disc 40 is disposed across the refiner gap 28 from its corresponding disc 38. Similarly, the refiner disc 36 is disposed across the refiner gap 28 from its corresponding refiner disc 34. The refiner disc 14 is also disposed opposing its corresponding refiner disc 12 but is constructed and arranged relative to the corresponding refiner disc in a novel manner described in more detail below.

Each of the opposed inner refining disc annuli 38 and 40 includes a refiner surface 54 and 56, respectively, facing one another. The corresponding refiner bars 39 and 41 protrude from the respective refiner surfaces 54 and 56 toward one another and toward the refining plane 42.

FIG. 2 illustrates a front view of a portion of the refiner disc annulus 38 facing the refiner surface 54. Such a disc portion is known in the art as a refiner disc segment. The segments are essentially separate portions of the entire refiner disc which are individually replaceable and therefore serviceable and removable from the carrier elements to which they are attached. The refiner disc segment of the annulus 38 shown in FIG. 2 is for illustrative purposes only and is not intended to limit the scope of the invention in any way. The disc segment 38 includes a plurality of refiner bars 39 extending from the refiner surface 54. The refiner bars 39 protrude axially relative to the central axis 22 from the refiner surface 54 and extend generally radially along the refiner surface. As is evident from the illustration in FIG. 2, the refiner bars define a varying curvature or surface contour and grooves between the refiner bars forming flow paths along the refiner surface 54 for the stock material. These flow paths may be altered according to the particular characteristics required for any given refining application. The height of the refiner bars, the groove depth, and the curvature and spacing may be altered in accordance with the requirements of a given application.

Similarly, the surface of each refiner disc annulus not described in detail herein, specifically, discs 12, 14, 34, 36 and 40 includes a refiner surface 58, 60, 62, 64 and 56, respectively, including thereon the corresponding refiner bars 13, 15, 35, 37 and 41 protruding generally in the same manner from the refiner surfaces and extending radially therealong as described for the disc segment 38.

As the stock material is urged along by the auger 18, it is propelled radially outward by the flinger nut 26 into the refining gap 28 between the opposed pairs of refiner disc assemblies. The material flows from between the inner disc annuli 38 and 40 to the middle disc annuli 34 and 36 and then between the outer disc annuli 12 and 14 before exiting the refiner gap 28 and continuing along through the housing 16 to an appropriate stock material outlet (not shown).

Figure 4:
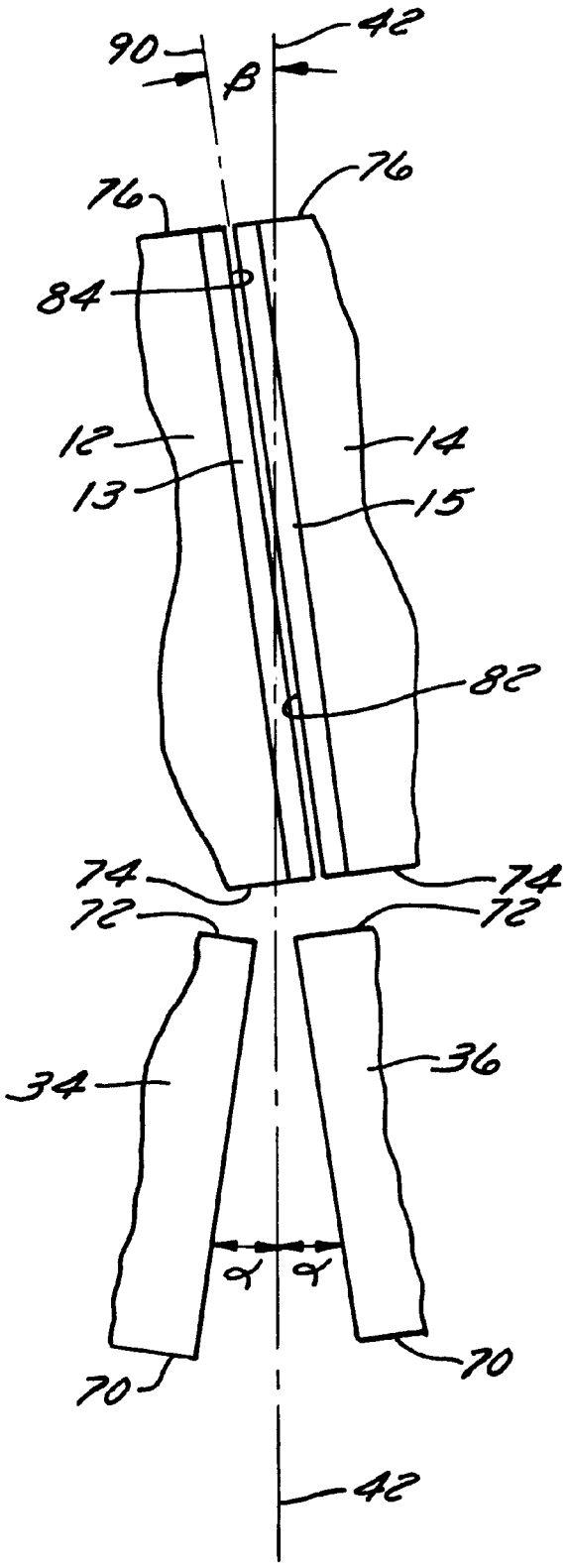
FIG. 4 illustrates a schematic view of the disc annuli geometry according to one embodiment of the present invention.

The refiner discs 34 and 36 and also 38 and 40 mirror one another so that they are correspondingly angled relative to the respective opposed disc somewhat symmetrically as is known currently in the art. As best illustrated in FIG. 3 and as schematically illustrated in FIG. 4, each of the inner and middle refiner discs 34, 36, 38 and 40 has an inner perimeter edge 70 and an outer perimeter edge 72. As is conventionally known in the art, these refiner disc annuli taper toward the refining plane 42 from the respective inner edges 70 to the outer edges 72. For example, the refining surface of each annulus 34, 36, 38 and 40 tapers at an angle $\alpha$ relative to the refining plane 42. Depending upon the application and particular refining requirements for a selected stock material, the angle $\alpha$ may vary considerably without departing from the scope of the present invention. Therefore, the inner annuli 38 and 40 as well as the middle annuli 34 and 36 essentially mirror one another and define a narrowing refining gap 28 therebetween as the stock material moves radially outward from the central axis 22 along the refining plane 42.

FIG. 3, by way of illustration, shows an alternative embodiment of the invention wherein the number of refining discs is reduced. The refining discs 34 and 36 as illustrated in FIG. 3 are the inner refining disc annuli as the discs 38 and 40 have been eliminated. This embodiment illustrates that the number of disc annuli is generally a matter of design choice depending upon the particular application for which the refiner is to be used. Typically, the innermost refiner discs have a greater taper angle but include a larger refining gap between the opposed discs. As one moves radially outward, the refining gap 28 narrows between each subsequent pair of opposed refiner discs and the taper angle $\alpha$ of the discs lessens. In a typical or conventional refiner disc apparatus, the outermost refiner discs define a fairly narrow refiner gap therebetween and include a relatively small taper angle $\alpha$ but otherwise are no different than the more radially inward pairs of refiner discs.

IV. Conical Refiner Disc Annulus Construction

In one embodiment of the present invention, the outermost refiner disc annuli 12 and 14 include a novel arrangement of the respective refiner surfaces 58 and 60. The refiner surfaces 58 and 60 do not taper toward or away from one another but instead taper in a corresponding manner relative to one another. As best illustrated in FIGS. 3 and 4, the refiner surface 58 of the refiner disc annulus 12 is disposed at a taper angle $\beta$ relative to the refiner plane 42. The refiner disc 12 has an inner edge 74 and a outer edge 76 and tapers along the refiner surface 58 between the inner and outer edges. However, as can be seen in FIG. 3, the refiner surface 58 tapers away from the refining plane 42 from the inner edge 74 to the outer edge 76.

Preferably, the conical tapered refiner surfaces 58 and 60 are oriented to define a refining zone 28 or refining gap 28 between them that comprises a generally annular portion of a conic section, a line or planar portion of which is depicted by phantom line 90. As is shown in FIGS. 1 and 3, the conical tapered discs 12 and 14 are oriented such that the line 90 defined essentially by their opposed refiner surfaces 58 and 60 defines a secondary refining plane 90 that is preferably acutely angled at an angle, $\beta$, relative to the primary refiner plane 42. Preferably, the primary refiner plane 42 comprises a plane that is generally perpendicular to the axis of rotation of the carrier elements 30 and 32. Preferably, the conical tapered refiner surfaces 58 and 60 define a secondary refining plane 90 such that, $\beta$, is greater than 0 degrees relative to the primary refiner plane 42. Preferably, the discs 12 and 14 can be constructed such that the secondary refining plane 90 defined by refiner surfaces 58 and 60 has an angle, $\beta$, greater than 0 degrees to about 20 degrees relative to the primary refiner plane 42. If desired, the angle of one or both refiner surfaces 58 and 60 relative to the primary refiner plane 42 can deviate slightly from that of the secondary refining plane 90, preferably no more than about ±5 degrees from $\beta$. In one preferred embodiment, $\beta$ is about 3 degrees. In another preferred embodiment, $\beta$ is about 5 degrees. Preferably, $\beta$ is no greater than about 20 degrees.

In the illustrated embodiment, the refiner surface 58 also includes an inlet portion 80 extending from the inner edge 74 for a short distance towards the outer edge 76. The inlet portion 80 of the refiner surface is generally parallel to the refining plane 42 and helps define a stock material entrance into the refining gap 28 between the refiner discs 12 and 14 as described in more detail below.

The refiner surface 60 of the opposed refiner disc 14 is oriented essentially parallel to the refiner surface 58 of the refiner disc 12. Viewing the cross section of each conical tapered refiner disc shown in FIG. 3, the refiner surface of the disc annulus 14 is essentially linear. The gap between the refiner surfaces 58 and 60 defined by the distance between axially outermost edges of respective refiner bars 13 and 15 (FIG. 3) is essentially constant over a substantial portion of the refiner discs 12 and 14. The refiner gap between the two discs adjacent the inlet portion 80 of the refiner surface 58 preferably is wider in order to facilitate stock material entry into the gap between the two discs. Also as illustrated in FIG. 3, the refiner bars 13 and 15 of the respective discs 12 and 14 have an axial outer edge 82 and 84, respectively, which are very closely spaced relative to one another as the refiner discs 12 and 14 pass one another during rotation and operation of the refiner 10.

Extending in a radial direction, the refiner surface 60, as stated before, is essentially linear. The refiner surface 60 adjacent the inner edge 74 of the refiner disc annulus 14 is disposed on the same side of the primary refining plane 42 as the carrier element 32 for the annulus 14. However, as the refiner surface 60 moves toward the outer edge 76 of the disc 14, the refiner surface 60 crosses over the primary refining plane 42 to the other side adjacent the opposed refiner disc 12. This is so that the two refiner surfaces 58 and 60 of the two discs taper correspondingly relative to one another so that the refiner gap 28 therebetween remains consistent over a substantial portion of the discs. The two refiner surfaces therefore define the secondary refining plane 90 at an angle β relative to the primary refining plane 42.

As will be evident to those skilled in the art, the axial height and radial length of the appropriate refiner disc annuli 12 and 14 as well as the taper angle β may be varied. The secondary refining plane 90 defined as a result can lie entirely on one side or the other of the primary refining plane 42 or, as in the present embodiment, extend from one side of the primary refining plane to the other.

The embodiment illustrated in FIG. 3 is preferred in that the stock material is forced into the refiner gap 28 between the disc annuli 12 and 14. The centrifugal force of the stock material and the angle β causes the material to hit or impinge against the refiner surface 60 of the disc annulus 14. The material is then forced between the two refiner discs 12 and 14 and is further refined by the very close relationship between the refiner bars 13 and 15 and the consistent refiner gap 28 therebetween. The secondary refining plane 90 may either taper toward the first carrier element 30 as is illustrated in FIG. 3 or may taper toward the second carrier element 32 without departing from the scope of the present invention. It is not essential that the plane 90 angle toward the rotating member or the stationary member if both are rotating relative to one another.

V. Use and Operation

In use, the refiner 10 utilizing the refiner disc apparatus of the invention is used to refine the fiber of a stock material in a more efficient manner. The refiner 10 of the invention may be utilized for any type of paper stock material refiner or wood fiber refiner and be utilized in refiners having only a single opposed disc annulus arrangement, counter rotating refiner arrangements, dual or double disc or twin refiners, or any other type of known material refiner. The particularly novel arrangement of the outermost refiner disc annuli 12 and 14 of the present embodiment increases the efficiency of the refiner 10, produces a fiber which is more developed than by using a conventional refiner, and eliminates several problems in the known conventional refiners involving build up of steam pressure and vibration of the refiner disc assemblies. While the conical tapered refiner disc annuli 12 and 14 of this invention are particularly well suited for use in refining fiber in a stock slurry, such as the kind typically used to make paper products and other fiber products, the conical tapered disc annuli are also well suited for other comminution applications where no fiber is involved. Examples of such applications include, for example, comminution of grain, plastics, garbage, recycled materials, and the like where the material being comminuted preferably is a component of a slurry of water or another liquid.

In operation, the stock material enters the housing 16 through the inlet 20 and is urged axially along the rotating shaft 24 by the auger 18. The flinger nut 26 propels the stock material radially outward into the refiner gap 28 between the innermost refiner discs 38 and 40 where it is preliminarily refined from a course stock material. Because the rotating first carrier element 30 rotates at very high speeds or rpm, the centrifugal force and the angular acceleration produced by the rotational speed and large diameter of the elements 30 and 32 cause a great amount of radial acceleration of the stock material toward the outer perimeter of the disc assemblies. The material is propelled next between the opposed middle refiner disc annuli 34 and 36 and further refined by the tighter refiner gap therebetween. The stock material is then further propelled into the refiner gap between the outermost refiner disc annuli 12 and 14 into the inlet defined between the inlet portion 80 of the refiner surface 58 and the refiner surface 60.

The stock material is then forced between the generally parallel refiner surfaces 58 and 60 of the two discs 12 and 14. The stock material is continually forced against the refiner surface 60 via centrifugal force and the angle β of the secondary refining plane 90. The stock material however is further refined and developed via the relatively consistent refiner gap between the refiner surfaces 58 and 60 along a substantial portion of the two refiner discs. The stock material is further refined by being forced between the refiner bars 13 and 15 of the two discs and the respective outer edges 82 and 84 which are in very close confronting relation to one another over a substantial portion of the discs. This further develops and refines the stock material fiber.

The angle β or angle of the secondary refining plane 90 angle of the outermost refiner discs 12 and 14 may vary depending upon the particular characteristics of the refining application as desired. Additionally, the radial length or distance between the inner edge 74 and outer edge 76 of the outermost refiner disc annuli 12 and 14 may also vary as desired depending upon the particular refining application. The construction of the conical annular refiner disc annuli 12 and 14 have been devised to insert directly into a conventional flat disc refiner and replace a typical set of outer refiner disc annuli.

The conical refiner discs 12 and 14 counteract the negative effects produced by the high rotational speeds and large disc diameters by providing a restriction to the centrifugal force which propels the stock material and fibers toward the outer diameter of the discs. The restriction produces longer residency times of the stock material between the closely spaced conical discs 12 and 14. The stock material fiber development is therefore improved within the refiner as a result of the extended residency time.

These benefits are produced without adversely affecting steam evacuation from the refiner gap 28. In a conventional refiner, obstruction dams are disposed between the refiner bars and utilized to increase the residency time. However, the dams obstruct flow of steam within the refiner gap 28 as well as stock material. The corresponding orientation of the refiner surfaces 58 and 60 and the angle β effectively throw the stock material from the inner tapered surface, for example the refiner surface 58 of the tapered disc 12, to the outer tapered surface, for example the refiner surface 60 of the disc 14 in the present embodiment. This phenomenon reduces the need for dams on the rotor or first carrier element 30 by creating additional restriction to the flow of material. In some instances, the need for such dams may be entirely eliminated.

The geometry of the conical disc annuli 12 and 14 also helps to prevent refiner disc vibration and disc upset which are typically caused by steam pressure fluctuations. This is because a portion of the force on the discs created by the steam pressure is now acting in a radial direction against the refiner surface 60 of the disc annulus 14 instead of upsetting the disc in an axial direction as in a conventional refiner caused by the narrowing refiner gap between two opposed discs.

It should be understood that the refiner 10 of the present invention may be employed in refiner applications of various configurations and constructions and for refining various types and consistencies of stock material. In particular, the conical refiner disc annuli 12 and 14 and their associated geometry may be utilized with any suitable disc refiner. Such a refiner may have one or more rotors and one or more counter-rotating or stationary refiner disc carrier elements and one or more pairs of opposed annular discs.

As will be evident to those skilled in the art, the present invention is not to be limited to a particular type or construction of disc carrier element or disc mounting to the carrier element. Additionally, the present invention is not to be limited to a particular construction of the mounting surface of the carrier element, the housing, the auger, the rotary shaft, or any other elements of the invention. The invention is further not to be limited to use of a particular type of material for fabricating and manufacturing the refiner disc annuli 12 and 14 or other refiner components. Any suitable materials may be employed which combine adequate features of strength, wear resistance and cost effectiveness.

It is also to be understood, that although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended to be limited only by the scope of the appended claims.

What is claimed:

1. A refiner disc assembly for a flat disc refiner comprising:

a carrier element having an outer radial periphery, at least one mounting surface, and an axis of rotation;

a first refiner disc carried by a first mounting surface of the at least one mounting surface that is disposed parallel to a plane that is generally perpendicular to the axis of rotation of the carrier element, the first refiner disc 1) being disposed radially inwardly of and adjacent to the outer radial periphery of the carrier element, 2) being disposed generally concentrically relative to the axis of rotation of the carrier element, and 3) having a first refiner surface facing generally outward and away from the first mounting surface;

a plurality of refiner bars protruding generally axially from and extending generally radially along the first refiner surface;

wherein the first refiner surface defines a first refining plane disposed at an angle that is acute relative to the plane that is generally perpendicular to the axis of rotation of the carrier element;

a second refiner disc carried by a second mounting surface of the at least one mounting surface that is disposed parallel to the plane that is generally perpendicular to the axis of rotation of the carrier element, the second refiner disc 1) being disposed radially inwardly of the first refiner disc, 2) being disposed generally concentrically relative to the axis of rotation, and 3) having a second refiner surface facing outward and away from the second mounting surface;

a plurality of refiner bars protruding axially from and extending generally radially along the second refiner surface;

wherein the second refiner surface defines a second refining plane 1) that is disposed generally parallel to the plane that is generally perpendicular to the axis of rotation of the carrier element, 2) that is disposed at an angle that is acute relative to the first refining plane, and 3) that intersects the first refining plane.

2. The refiner disc assembly according to claim 1, wherein the first refining surface is disposed at an angle of as much as about 20 degrees relative to the plane that is generally perpendicular to the axis of rotation of the carrier element.

3. The refiner disc assembly according to claim 2, wherein the angle is about 3 degrees.

4. The refiner disc assembly according to claim 1 wherein a) one of the carrier elements rotates relative to the other of the carrier elements at a rotational speed of at least about 1200 revolutions per minute, b) there is a gap between opposed refiner surfaces of no greater than about 0.040 inches, c) each refiner disc is comprised of at least a plurality of refiner disc segments, d) stock containing wood fiber is introduced between the refining surfaces, and e) the stock flows radially outwardly between the refiner surfaces.

5. A refiner disc assembly for a flat disc refiner comprising:

a rotary first carrier element having a first mounting surface that is generally flat and a central axis of rotation;

an annular first disc carried on the first mounting surface concentrically relative to the central axis and having a first refiner surface facing outward from the first mounting surface;

a plurality of first refiner bars protruding axially from and extending generally radially along the first refiner surface;

a second carrier element spaced from and confronting the first carrier element, the second carrier element having a second mounting surface that is generally flat, the second mounting surface being generally parallel to the first mounting surface;

an annular second disc carried on the second mounting surface concentrically relative to the central axis and having a second refiner surface confronting the first refiner surface, a substantial portion of the first and second refiner surfaces disposed generally parallel to one another;

a plurality of second refiner bars protruding axially from and extending generally radially along the second refiner surface;

a mounting plane defined between the first and second carrier elements that is generally perpendicular to the central axis of rotation;

a refining plane defined between the first and second refiner surfaces, the refining plane oriented at an angle that is acute relative to the mounting plane;

an annular third disc carried on the first mounting surface concentrically relative to the central axis and radially inward of the first disc, the third disc having an inner perimeter edge, an outer perimeter edge, a third refiner surface, and a plurality of third refiner bars protruding axially from and extending generally radially along the third refiner surface;

an annular fourth disc carried on the second mounting surface concentrically relative to the central axis and confronting the third disc, the fourth disc having an inner perimeter edge, an outer perimeter edge, a fourth refiner surface, and a plurality of fourth refiner bars protruding axially from and extending generally radially along the fourth refiner surface; and wherein the third and fourth refiner surfaces are tapered toward one another in a direction from adjacent the inner respective perimeter edges to adjacent the outer respective perimeter edges of the third and fourth refiner discs such that a refiner gap between the third disc and the fourth disc narrows in a radial outward direction.

6. The refiner disc assembly according to claim 5, wherein the first and second refiner surfaces is each disposed at an angle, β, that is greater than 0 degrees and no greater than 20 degrees relative to a refining plane between the third and fourth refiner surfaces that is generally perpendicular to the central axis of rotation.

7. The refiner disc assembly according to claim 5, wherein the taper plane angle of the refining plane is greater than 0 degrees and no greater than about 20 degrees relative to the mounting plane.

8. The refiner disc assembly according to claim 7, further comprising:

an inner perimeter edge and an outer perimeter edge on each of the first and second discs; and wherein the first refiner surface tapers toward one of the first and second carrier elements from its inner perimeter edge to its outer perimeter edge, and the second refiner surface tapers toward the same one of the first and second carrier elements from its inner perimeter edge to its outer perimeter edge.

9. The refiner disc assembly according to claim 5, wherein the second carrier element is a rotary carrier element, the first and second carrier elements capable of rotation relative to one another in opposite rotational directions.

10. The refiner disc assembly according to claim 5, wherein the assembly is adapted for refining a wood stock material for the process of making paper products.

11. A flat disc stock material refiner comprising:

a housing defining a refining chamber therein;

a stock material inlet in the housing communicating with the refining chamber;

an auger carried on a rotary shaft within the refining chamber and which rotates about an axis;

a first carrier element concentrically and rotationally mounted relative to the axis within the refining chamber, the first carrier element having a first mounting surface that is generally perpendicular to the axis;

an annular first disc carried on the first mounting surface concentrically relative to the axis and having a first refining surface facing outward from the first mounting surface;

a plurality of first refiner bars protruding axially from and extending generally radially along the first refining surface;

a second carrier element spaced from and confronting the first carrier element within the refining chamber, the second carrier element having a second mounting surface that is generally perpendicular to the axis and generally parallel to the first mounting surface;

an annular second disc carried on the second mounting surface concentrically relative to the axis and having a second refining surface confronting the first refining surface with a refining gap between the first and second refining surfaces, the first and second refining surfaces being disposed generally parallel to one another;

a plurality of second refiner bars protruding axially from the second refining surface and extending generally radially along the second refining surface;

a primary plane defined between the first and second mounting surfaces that is generally perpendicular to the axis;

a refining plane that 1) is disposed in the refining gap between the first and second refining surface, 2) extends between the first and second refining surfaces and 3) does not contact the first and second refining surfaces; and wherein the refining plane is oriented at an angle that is acute relative to the primary plane.

12. The stock material refiner according to claim 11, wherein the first carrier element is mounted to and rotates in conjunction with the rotary shaft.

13. The stock material refiner according to claim 12, wherein the second carrier element is stationary and is mounted to a portion of the housing.

14. The stock material refiner according to claim 12, wherein the second carrier element is rotationally mounted within the refining chamber and rotates concentrically and in an opposite direction relative to the first carrier element.

15. The stock material refiner according to claim 11, adapted for use in refining wood pulp stock material for the process of making paper products.

16. A method of refining a stock material using a flat disc refiner, the method comprising the steps of:

providing a stock material refiner having a housing and a pair of opposed carrier elements within the housing which rotate relative to one another about an axis, each carrier element having a generally flat mounting surface, wherein one of the mounting surfaces is generally parallel to the other of the mounting surfaces and both of the mounting surfaces are generally perpendicular to the axis, a first pair of opposed refiner discs mounted to the mounting surfaces that both have a plurality of refiner bars that define a pair of first refiner surfaces, and a second pair of opposed refiner discs mounted to the mounting surfaces radially inwardly of the first pair of opposed refiner discs and which both have a plurality of refiner bars that define a pair of second refiner surfaces;

orienting the first refiner surfaces so that each first refiner surface is generally parallel to the other first refiner surface so as to define a first refining plane between the refiner surfaces, the first refining plane disposed at an angle relative to a plane defined between the mounting surfaces of the carrier elements that is generally parallel to the mounting surfaces and generally perpendicular to the axis;

orienting the second refiner surfaces so that each second refiner surface is generally parallel to the other second refiner surface so as to define a second refining plane between the refiner surfaces, the second refining plane disposed substantially parallel to the plane defined between the mounting surfaces;

moving a stock material to be refined between the carrier elements into a first refining gap between the second refiner surfaces;

rotating at least one of the second refiner discs relative to the other of the second refiner discs so as to refine the stock material between the second refiner surfaces as the stock material is propelled radially outward in a direction generally perpendicular to the axis toward the first refiner discs;

moving the stock material to be refined between the carrier elements into a second refining gap between the first refiner surfaces; and rotating at least one of the first refiner discs relative to the other of the first refiner discs so as to further refine the stock material between the first refiner surfaces as the stock material is propelled generally radially outward relative to the axis at an acute angle relative to the direction the stock material is propelled between the second refiner discs.

17. A method of refining a wood pulp stock material using a flat disc refiner, the method comprising the steps of:

providing a refiner having a housing and a pair of opposed carrier elements within the housing which rotate relative to one another about an axis of rotation, each carrier element having a mounting surface that is generally perpendicular to the axis of rotation and at least one first annular refiner disc on each mounting surface, each first refiner disc having a first refiner surface with a plurality of refiner bars thereon facing away from the mounting surface of each carrier element and a second annular refiner disc on each mounting surface, each second refiner disc having a second refiner surface with a plurality of refiner bars thereon facing away from the mounting surface of each carrier element;

orienting the first refiner discs such that the first refiner surfaces are closely spaced relative to one another forming a refiner gap therebetween that defines a first refining plane that is acutely angled relative to a plane that is generally perpendicular to the axis of rotation;

orienting the second refiner discs radially inwardly of the first refiner discs such that the second refiner surfaces are closely spaced relative to one another forming a refiner gap therebetween that defines a second refining plane that is generally perpendicular to the axis of rotation;

delivering a stock material into the housing of the refiner;

rotating at least one of the carrier elements relative to the other;

urging the stock material into the refiner gap between the second refiner discs such that the stock material flows radially outward relative to the second refiner discs in a direction that is generally parallel to the generally perpendicular rotational axis plane; and urging the stock material into the refiner gap between the first refiner discs such that the stock material flows radially outward relative to the refiner discs in a direction that is acutely angled relative to the generally perpendicular rotational axis plane.

18. A flat disc refiner for refining stock containing wood fiber comprising:

a first refiner disc carrier having a first refiner disc mounting surface and an axis about which the first refiner disc carrier rotates;

a second refiner disc carrier having a second refiner disc mounting facing the first refiner disc mounting surface of the first refiner disc carrier with the first refiner disc mounting surface generally parallel to the second refiner disc mounting surface and generally perpendicular to the axis of rotation;

a first refiner disc mounted to the first refiner disc mounting surface of the first refiner disc carrier, the first refiner disc having a first refiner surface disposed at an angle that is acute relative to the first refiner disc mounting surface;

a second refiner disc mounted to the second refiner disc mounting surface of the second refiner disc carrier, the second refiner disc having a second refiner surface disposed at an angle that is acute relative to the second refiner disc mounting surface, the second refiner surface disposed generally parallel to the first refiner surface, facing the first refiner surface, and spaced from the first refiner surface defining a refiner gap therebetween;

a third refiner disc mounted to the first refiner disc carrier and having a third refiner surface comprised of a plurality of pairs of upraised refiner bars;

a fourth refiner disc mounted to the second refiner disc carrier and having a fourth refiner surface opposing the third refiner surface and comprised of a plurality of pairs of upraised refiner bars;

wherein the third refiner surface and the fourth refiner surface are generally parallel to a) each other, b) the first refiner disc mounting surface and c) the second refiner disc surface.

19. The flat disc refiner according to claim 18 wherein the third refiner disc is disposed radially inwardly of the first refiner disc, the fourth refiner disc is disposed radially inwardly of the second refiner disc, wherein the third refiner surface is spaced from the fourth refiner surface by a refiner gap, wherein the gap between the third refiner surface and the fourth refiner surface narrows in a radial outward direction, and the gap between the first refiner surface and the second refiner surface narrows in a radial outward direction.

20. The flat disc refiner according to claim 19 wherein the first mounting surface is flat and the second mounting surface is flat.

21. The flat disc refiner according to claim 19 wherein a) one of the refiner disc carriers rotates relative to the other of the refiner disc carriers at a rotational speed of at least about 1200 revolutions per minute, b) there is a gap between the refining surfaces of the first refiner disc and the second refiner disc of no greater than about 0.040 inches, c) the angle of the first refiner surface is greater than 0 degrees and no greater than about 20 degrees.

22. The flat disc refiner according to claim 21 further further comprising a fifth refiner disc mounted to the first refiner disc carrier against the first refiner disc mounting surface and having a fifth refiner surface comprised of a plurality of pairs of upraised refiner bars, a sixth refiner disc mounted to the second refiner disc carrier against the second refiner disc mounting surface and having a sixth refiner surface opposing the fifth refiner surface and comprised of a plurality of pairs of upraised refiner bars, wherein the fifth refiner surface and the sixth refiner surface are generally parallel to a) each other, b) the first refiner disc mounting surface and c) the second refiner disc surface.

23. A flat disc refiner for refining stock containing wood fiber comprising:

a first refiner disc carrier having an axis about which the first refiner disc carrier rotates;

a second refiner disc carrier disposed adjacent the first refiner disc carrier;

a first refiner disc mounted to the first refiner disc carrier, the first refiner disc having a first refiner surface;

a second refiner disc mounted to the second refiner disc carrier, the second refiner disc having a second refiner surface that faces the first refiner surface;

a third refiner disc mounted to the first refiner disc carrier radially inwardly of the first refiner disc and generally radially aligned with the first refiner disc, the third refiner disc having a third refiner surface;

a fourth refiner disc mounted to the second refiner disc carrier radially inwardly of the second refiner disc and generally radially aligned with the second refiner disc, the fourth refiner disc having a fourth refiner surface;

wherein the third refiner surface and the fourth refiner surface define a primary refining plane therebetween that is generally perpendicular to the axis of rotation; and wherein the first refiner surface and the second refiner surface define a secondary refining plane therebetween that is angled acutely relative to the primary refining plane.

24. The flat disc refiner according to claim 23 wherein a) the third refiner disc has i) a portion disposed on one side of the primary refining plane and ii) a portion disposed on the other side of the primary refining plane, and b) the fourth refiner disc has i) a portion disposed on one side of the primary refining plane and ii) a portion disposed on the other side of the primary refining plane.

25. The flat disc refiner according to claim 23 wherein the secondary refining plane is disposed at an angle of at least 0 degrees and no greater than about 20 degrees.

26. The flat disc refiner according to claim 25 wherein a flow of stock is directed axially toward the refiner disc carriers and the secondary refining plane is angled away from the flow of stock.

27. The flat disc refiner according to claim 23 wherein the first and second refiner discs are each comprised of a plurality of refiner disc segments.

28. A refiner for refining stock material containing fiber comprising:

a refiner housing;

a first refiner disc carrier received in the housing, the first refiner disc carrier having at least one mounting surface, a portion of which is generally flat and generally perpendicular to an axis about which the first refiner disc carrier rotates during operation;

a second refiner disc carrier received in the housing, the second refiner disc carrier having at least one mounting surface, a portion of which is 1) generally flat and facing the mounting surface of the first refiner disc carrier, 2) generally parallel to the mounting surface of the first refiner disc carrier, and 3) generally perpendicular to the axis of rotation about which the first refiner disc carrier rotates during operation;

a first pair of opposed refiner discs having one of the refiner discs of the first pair removably mounted to a mounting surface of the first refiner disc carrier and the other of the refiner discs of the first pair removably mounted to a mounting surface of the second refiner disc carrier with each refiner disc of the first pair having a refiner surface comprised of upraised bars with the refiner surface being generally perpendicular to the axis of rotation, the refiner surfaces facing each other and spaced apart from each other by a gap that is no greater than about 0.40 inches;

a second pair of opposed refiner discs disposed radially outward of the first pair with one of the refiner discs of the second pair removably mounted to a mounting surface of the first refiner disc carrier and the other of the refiner discs of the second pair mounted to a mounting surface of the second refiner disc carrier with each refiner disc of the second pair having a refiner surface that is angled in the same direction acutely at an angle that is not greater than about 20 degrees relative to a plane perpendicular to the axis of rotation, the refiner surfaces of the refiner discs of the second pair facing each other and being spaced apart from each other by a gap of not more than about 0.40 inches;

wherein one of the refiner discs of the first pair is aligned with one of the refiner discs of the second pair and the other of the refiner discs of the first pair is aligned with the other of the refiner discs of the second pair;

wherein each one of the refiner discs of the second pair is comprised of a plurality of refiner disc segments removably mounted to one of the mounting surfaces; and wherein the first pair of opposed refiner discs define a first refining plane therebetween, the second pair of opposed refiner discs define a second refining plane therebetween, and the first refining plane intersects the second refining plane adjacent a middle portion of each one of the refiner discs of the second pair such that the first refining plane intersects each one of the refiner discs of the second pair.

29. A flat disc refiner for refining a fibrous stock slurry comprising:

a housing defining a refining chamber therein;

a stock inlet in the housing communicating with the refining chamber;

an auger carried on a rotary shaft within the refining chamber and which rotates about an axis;

a first carrier element generally concentrically and rotationally mounted relative to the axis within the refining chamber, the first carrier element having a first mounting surface that is generally perpendicular to the axis;

an annular first disc carried on the first mounting surface generally concentrically relative to the axis and having a first refining surface facing outwardly away from the first mounting surface;

a plurality of first refiner bars protruding axially from and extending generally radially along the first refining surface;

a second carrier element spaced from and confronting the first carrier element within the refining chamber, the second carrier element having a second mounting surface that is generally perpendicular to the axis;

an annular second disc carried on the second mounting surface generally concentrically relative to the axis of rotation and having a second refining surface confronting the first refining surface, the first and second refining surfaces disposed generally parallel to one another;

a plurality of second refiner bars protruding axially from the second refining surface and extending generally radially along the second refining surface;

a primary plane defined between the mounting surfaces of the first and second carrier elements that is generally perpendicular to the axis of rotation;

a first refining plane disposed between the first and second refining surfaces, the first refining plane oriented at an angle that is acute relative to the primary plane;

an annular third disc carried on the first mounting surface generally concentrically relative to the axis and having a third refining surface facing outwardly away from the first mounting surface;

a plurality of third refiner bars protruding axially from and extending generally radially along the third refining surface;

an annular fourth disc carried on the second mounting surface generally concentrically relative to the axis and having a fourth refining surface confronting the third refining surface, the third and fourth refining surfaces being disposed generally parallel to one another;

a plurality of fourth refiner bars protruding axially from the fourth refining surface and extending generally radially along the fourth refining surface;

a second refining plane disposed between the third and fourth refining surfaces, the second refining plane oriented 1) generally parallel to the primary plane, and 2) at an angle that is acute relative to the first refining plane; and wherein stock received in the stock inlet 1) flows axially in a first direction that is generally parallel to the direction of the axis of rotation, 2) flows radially outwardly along the second refining plane between the third and fourth refining surfaces in a second direction that is generally perpendicular to the first direction, and 3) then flows along the first refining plane between the first and second refining surfaces in a third direction that is disposed at an acute angle relative to the second direction such that the stock, as it travels along the first refining plane, is displaced both in a direction axially parallel to the axis of rotation and in a generally radially outward direction.

* * * * *